US007159514B2

(12) United States Patent
Eckert et al.

(10) Patent No.: US 7,159,514 B2
(45) Date of Patent: Jan. 9, 2007

(54) PRINTING MACHINES COMPRISING SEVERAL PRINTING GROUPS

(75) Inventors: Günther Oskar Eckert, Zellingen (DE); Edgar Mayländer, Estenfeld (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 118 days.

(21) Appl. No.: 10/524,287

(22) PCT Filed: Aug. 1, 2003

(86) PCT No.: PCT/DE03/02598

§ 371 (c)(1),
(2), (4) Date: Feb. 11, 2005

(87) PCT Pub. No.: WO2004/024448

PCT Pub. Date: Mar. 25, 2004

(65) Prior Publication Data

US 2005/0257702 A1 Nov. 24, 2005

(30) Foreign Application Priority Data

Aug. 12, 2002 (DE) ..... 102 36 864

(51) Int. Cl.
*B41F 13/56* (2006.01)

(52) U.S. Cl. ..... 101/227; 101/180; 101/221

(58) Field of Classification Search ..... 101/178, 101/179, 180, 219, 220, 221, 226, 227, 232, 101/483, 485, 486
See application file for complete search history.

(56) References Cited

U.S. PATENT DOCUMENTS

| | | | | |
|---|---|---|---|---|
| 1,717,381 | A | 6/1929 | Halliwell | |
| 1,805,681 | A | 5/1931 | Ball | |
| 5,117,753 | A | 6/1992 | Mamberer | |
| 5,775,222 | A * | 7/1998 | Zweifel et al. | 101/227 |
| 5,809,882 | A | 9/1998 | Ruckmann et al. | |
| 6,082,259 | A | 7/2000 | Siegenthaler et al. | |
| 6,526,889 | B1 * | 3/2003 | Tokiwa | 101/485 |
| 6,821,038 | B1 * | 11/2004 | Izawa | 400/621.1 |

FOREIGN PATENT DOCUMENTS

| | | |
|---|---|---|
| DE | 198 806 | 8/1920 |
| DE | 58 311 | 10/1967 |
| DE | 40 12 396 | 10/1991 |
| DE | 44 08 027 | 9/1995 |
| EP | 0 888 887 | 1/1999 |

* cited by examiner

*Primary Examiner*—Ren Yan
(74) *Attorney, Agent, or Firm*—Jones, Tullar & Cooper, P.C.

(57) ABSTRACT

A printing machine is comprised of several printing groups, at least one dryer and at least one folding apparatus. At least two of the printing groups are arranged side by side in the axial direction of the cylinders in the printing groups. A longitudinal direction of the dryer extends perpendicular to the axes of rotation of at least one cylinder group which defines a printing gap.

17 Claims, 1 Drawing Sheet

PRINTING MACHINES COMPRISING SEVERAL PRINTING GROUPS

CROSS-REFERENCE TO RELATED APPLICATIONS

This U.S. patent application is the U.S. national phase, under 35 USC 371, of PCT/DE2003/002598, filed Aug. 1, 2003; published as WO 2004/024448 A1 on Mar. 25, 2004 and claiming priority to DE 102 36 864.3 filed Aug. 12, 2002, the disclosures of which are expressly incorporated herein by reference.

FIELD OF THE INVENTION

The present invention is directed to printing presses with several printing groups. The printing press also includes at least one dryer and at least one folder.

BACKGROUND OF THE INVENTION

A web of material, such as, for example, a web of fabric to be imprinted, or such as a paper web, is imprinted in each printing group of a press that includes several printing groups. Following their passage through the dryer, the webs are combined into a strand, which is divided into individual groups, stacks or batches.

Customarily, the imprinted webs are conducted out of the printing groups of such a press, which printing groups are placed aligned in a first direction. The web is conducted in a direction which extends in a plane defined by this first direction and a vertical line.

This method of guiding the web raises a number of problems. If it is desired to assign a separate dryer to each printing group, for drying the web imprinted in that printing group, the option basically exists to arrange the dryer vertically above the printing group in an extension of the printing group. The result is that extremely high buildings are required for the placement of such a printing press with its included drier. If, on the other hand, it is decided to conduct the webs horizontally through the drying devices, an arrangement results in which the dryers are placed between the printing groups. Therefore, the press has a very great length in the alignment direction. This leads to greatly different web lengths between the individual printing groups and the folder, so that the printing groups must be operated with a large phase offset in order achieve a correct position of the webs, with respect to each other, at the folder.

Although a more compact construction could possibly be achieved by the provision of a common dryer, through which the webs from all of the printing groups are conducted together, this possible solution has the disadvantage that, depending on the placement of the dryer with respect to the printing groups, webs must be conducted between the printing group in which they were printed, and the dryer over long distances. These webs must thus be supported, or must be rerouted several times. In the course of this web support or rerouting, smearing of the not yet dry ink, due to contact of the web with the deflection rollers or the support rollers can occur. Such smearing results in a loss of quality of the printed products.

DD 58 311 discloses a rotary printing press. A dryer is placed downstream of each printing group, and several folders are also provided.

DE 40 12 396 A1 and DE 44 08 027 A1 both show web-fed printing presses with dryers and folders. The axes of rotation of the folding cylinders of the folder extend parallel with the longitudinal direction of the dryer.

EP 888 887 A2 discloses a rotary printing press with several printing towers and several folders. The axes of rotation of the folding cylinders extend parallel with respect to the axes of rotation of the printing cylinders.

A printing press with several printing groups, which are arranged in the axial direction of the cylinder shafts, is known from DE 198 806 C. An inlet of the formers is arranged transversely with respect to the printing cylinders.

SUMMARY OF THE INVENTION

The object of the present invention is directed to providing printing presses with several printing groups.

This object is attained in accordance with the present invention by the provision of a printing press having a plurality of printing groups and at least two folders. An axis of rotation of a first transverse cutting cylinder of the two folders is parallel to an axis of rotation of at least one of the cylinder groups defining a printing gap. With respect to an axial direction of its cylinders, at least one printing group is arranged next to another printing group. The two folders are placed aligned. The two folders are each situated in a space between two structural components each consisting of a printing group, a dryer and a turning bar.

It is a particular advantage of the printing press in accordance with the present invention that it provides a compact construction with short travel paths of all of the webs to be imprinted between each web's printing group and the folder. Since the imprinted webs each exit from their associated printing group transversely with respect to the alignment direction of the printing group, the dryers can be arranged transversely with respect to the alignment direction of the printing group, and therefore require neither a large structural height nor large distances between the printing groups in the alignment direction.

The axes of the cylinders defining the printing gaps of the printing groups are oriented parallel to the alignment direction, so that each imprinted web can be conducted to the associated dryer, from the outlet of the printing group, without deflection or turning.

The path of guidance of the webs to be imprinted from the bottom to the top of each one of the printing groups makes possible an arrangement of the dryers approximately at the outlet level of the webs from the printing groups, so that a space at the bottom of each printing group, which space remains unoccupied underneath the dryers, can be used for other purposes. For example, roll changers, which are useable for the material supply of webs to the printing groups, as well as possibly conveying devices that are useable for transporting fresh rolls of material to be imprinted to the roll changers and for carrying off used rolls, can be arranged in a useful manner in the space below the dryers.

The printing press in accordance with the present invention is equipped with two folders. These two folders are also usefully set up in the alignment direction.

The folders are preferably each located in a space between two adjacent structural components, each of such structural components being formed by a printing group, a dryer and a turning bar arrangement for use in feeding the web of material exiting from the dryer to the folder. In this arrangement of folders and structural components, it is possible to feed a paper web, that has been imprinted in one of the printing groups, selectively to one of the two folders. If the number of pages of a product to be printed does not fully occupy the capacity of the printing groups, the option is provided by this arrangement of printing groups and folders to employ a printing group, which is not required for the first print job, together with the second folder, for producing a second printed product, which second printed product can be independent of the first one.

A further advantage of the present invention resides in that production does not come to a stop if one folder fails. Such production can be continued through the use of the second folder instead of through the use of the first folder.

Preferably, the first of the two folders is arranged centered between two of the structural components in order to minimize the differences in the path lengths between the output of the individual printing groups.

It is also within the scope of the present invention to arrange the first and second folders in spaces which do not adjoin.

BRIEF DESCRIPTION OF THE DRAWINGS

A preferred embodiment of a printing machine in accordance with the present invention is represented in the drawings and will be described in greater detail in what follows.

Shown are in.

DESCRIPTION OF THE PREFERRED EMBODIMENT

Figure 1:
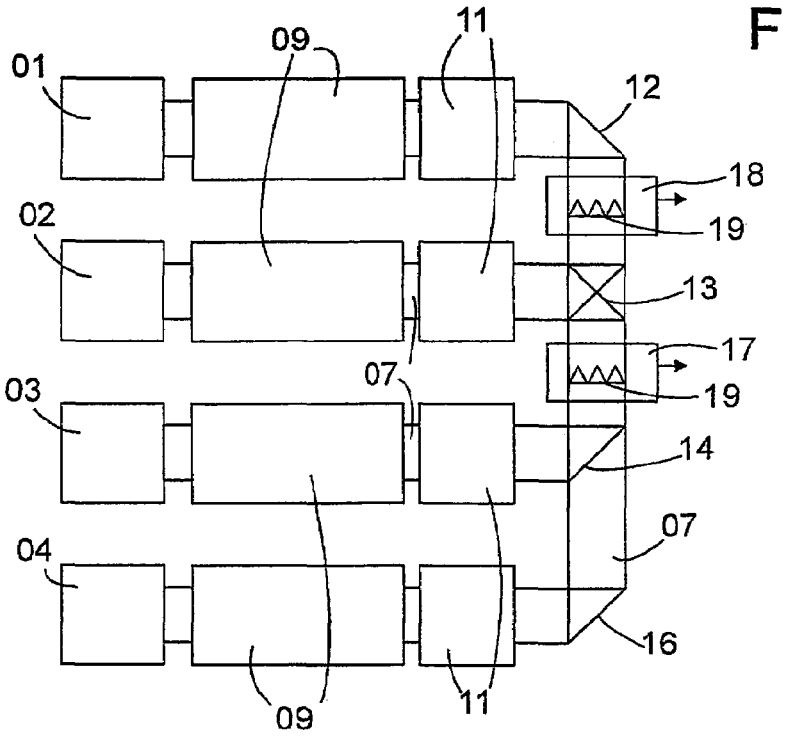
FIG. 1, a schematic top plan of view a printing press in accordance with the present invention, and in FIG. 2, a schematic side elevation view of the printing press in accordance with the present invention.
Figure 2:
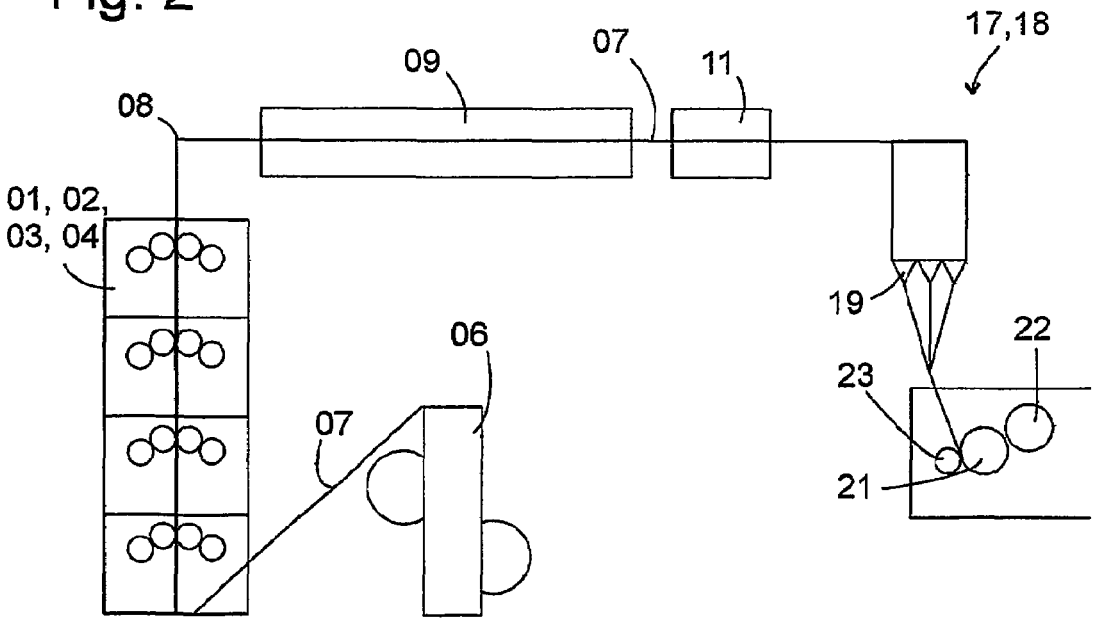

A somewhat schematic top plan view of a printing press, and in particular of a heat-set printing press for use in the printing of telephone directories, is represented in FIG. 1. The printing press comprises four four-color printing groups 01, 02, 03, 04, which are arranged for a width of six pages of the web 07 to be imprinted. The axes of the various printing cylinders in each of the printing groups 01, 02, 03, 04 lie parallel with respect to each other and to the alignment direction of the printing groups. This direction is vertical as viewed in FIG. 1. In other words, the axes of rotation of the printing groups 01, 02, 03, 04 are in the plane of FIG. 1 and extend in that plane. As represented in FIG. 2, each printing group 01, 02, 03, 04 is supplied with a paper web 07 by a roll changer 06, which paper web 07 enters its respective one of the printing groups 01, 02, 03, 04 at the base of the respective printing group and leaves its respective printing group 01, 02, 03, 04 at the upper end of that printing group.

Because of the arrangement of the printing groups 01 to 04 with the cylinder axes of the printing groups extending parallel in the alignment direction of the four printing groups 01, 02, 03, 04, it is not possible, as would be the situation with a conventional construction of printing groups in series, and in cases where four-color printing is not performed in every printing group and where more webs than printing groups exist, to conduct a paper web successively through two printing groups for being able to imprint the web in the two printing groups simultaneously. However, this limitation is not disadvantageous in connection with the use of the subject invention as a telephone directory printing press, since printing of telephone directories, in particular for the North American market, is essentially performed in four colors.

In the schematic representation of the present invention, as shown in FIG. 2, the paper web 07 is represented as initially being conducted vertically out of the printing group 01. The now printed web 07 is deflected into a generally horizontal path at a turning or deflection point 08, which turning or deflection point 08 can be provided by a deflection roller. It is, of course, also possible to construct each of the printing groups 01, 02, 03, 04 in such a way that the paper web 07 leaves the last printing gap directly in a horizontal orientation and is, in this orientation conducted to a dryer 09 which is arranged downstream of the printing group 01 without the paper web 07 being deflected at all once it has left the printing group.

A longitudinal direction of the dryer 09 is arranged transversely to the axes of rotation of at least one cylinder group defining the printing gap in the respective one of the printing groups 01, 02, 03, 04 with which the dryer is associated.

The horizontally oriented dryer 09 is arranged above the roll changer 06, as seen in FIG. 2. The dryer 09 thus does not occupy its own space for its placement. Instead, it utilizes space above the roll changer 06, which space would otherwise not be fully utilized.

A cooling roller arrangement 11 is located at the outlet of each dryer 09, as schematically depicted in both FIGS. 1 and 2. After passing through a cooling roller arrangement 11, the paper web reaches one of several turning bars 12, 13, 14 or 16, at which it is deflected into the alignment direction by being turned 90° with respect to the longitudinal direction of the associated one of the four dryers 09. It will be recalled that the alignment direction is the direction of the axes of rotation of the cylinders defining the printing gaps in the four printing groups 01, 02, 03, 04.

The printing press in accordance with the present invention has four structural components, each of these structural components being assembled including a printing group 01 to 04, one of the turning bars 12, 13, 14 or 16, and one of each of the dryer 09 and the cooling roller arrangement 11 placed between them.

As may be seen most clearly in FIG. 1, a first folder 17 is arranged in a space between the second and third structural components containing the second and third printing groups 02 or 03, respectively. A structurally identical second folder 18 is located between the first and second structural components, all as may be seen in FIG. 1. The turning bar 13 of the second structural component can be flipped over so that it can be used to feed the paper web 07 imprinted by the printing group 02 selectively to the first folder or to the second folder 17 or 18, as schematically depicted in FIG. 1.

Each folder 17, 18 has two longitudinal web cutting blades, which are not specifically represented for use to accomplish the longitudinal cutting of each of the paper webs 07 fed to the respective folder 17, 18 into three longitudinally extending partial webs, each partial web having a width of two pages. Each folder further includes three longitudinal fold formers 19 for the longitudinal folding of the three partial webs obtained by the longitudinal web being cut into three longitudinally extending partial webs.,] A transverse cutting unit utilizing a transverse cutting cylinder 23 is then used for separating the longitudinally folded and now stacked three partial webs into individual groups or batches. A folding blade cylinder 21 which, together with a cooperating folding jaw cylinder 22, transversely folds the groups or batches obtained by the transverse cutting of the stacked partial web, and a stack elevator, which is not specifically shown, are arranged downstream of the longitudinal fold formers 19. The overall construction and operation of such a folder is generally known in the art and need not be explained in detail here.

printing group is received. For each one of the folders 17, 18 the mode of operation; i.e. "collection" or "no collection", is shown, as well as the number of groups or batches obtained per revolution of the plate cylinders and the number of their pages.

| Printing | Printing | Printing | Printing | Folder 17 | | | Folder 18 | | |
|---|---|---|---|---|---|---|---|---|---|
| Group 01 | Group 02 | Group 03 | Group 04 | Coll.* | Batch | Pages | Coll.* | Batch | Pages |
| 17 | 17 | 17 | 17 | n | 2 | 96 | — | — | — |
| 17 | 17 | 17 | 18 | n | 2 | 72 | n | 2 | 24 |
| 17 | 17 | 17 | 18 | n | 2 | 72 | y | 1 | 48 |
| 17 | 17 | 18 | 18 | n | 2 | 48 | n | 2 | 48 |
| 17 | 17 | 18 | 18 | n | 2 | 48 | y | 1 | 96 |
| 17 | 17 | 18 | 18 | y | 1 | 96 | y | 1 | 96 |
| 17 | 18 | 18 | 18 | n | 2 | 24 | n | 2 | 72 |
| 17 | 18 | 18 | 18 | y | 1 | 48 | n | 2 | 72 |
| 18 | 18 | 18 | 18 | — | — | — | n | 1 | 96 |

*Coll. = Collection Operation

The axes of rotation of the first transverse cutting cylinders 23 of each of the two folders 17, 18, and the axes of rotation of at least one cylinder group delimiting a printing gap in associated ones of the printing groups 01, 02, 03, 04 are arranged to extend parallel to each other.

An advantage of the provision of the two essentially similar folders 17, 18 is that redundancy is provided, so that in the unlikely event of the failure of one of these folders 17, 18, it is possible to continue the operation of the printing press by using the other one of the two folders.

A particular advantage of the provision of the two folders 17, 18 is the increased flexibility in production which they provide. A printing press with a single folder only runs at the best possible efficiency if all of its printing groups print webs of maximum width. In case of the preferred embodiment disclosed here, having four printing groups 01 to 04 which each imprint both sides of their respective web 07, and using webs 07 of a width of six pages, this means that 48 pages are being printed with each rotation of the printing cylinders by one plate width or page height. If it is assumed that each of the printing cylinders supports four plates in the circumferential direction, which four plates are different in pairs, twice 96 pages are being printed during each complete revolution of the printing cylinders. This therefore is an amount of groups or batches at which the optimal use of the press results if only one folder is provided. However, such amounts of groups or batches are not always obtained. In general, when printing a telephone directory, there will be at least one group or batch which is smaller.

In connection with the printing press depicted and described in connection with the present invention, there are a multitude of possibilities for feeding or directing the webs 07 imprinted in the individual printing groups 01 to 04 to different ones of the folders 17, 18, and for processing these webs 07 in the folders 17, 18, independently of each other. When a group or batch to be produced does not reach the optimal amount of 96 pages, and can be imprinted by using fewer than the four maximally possible webs, printing groups not needed for this first production, together with one of the two folders 17, 18, can be employed for a different production. This results in a plurality of production options, which plurality of production options have been set forth in the table below. In that table, for each one of the printing groups 01 to 04, the respective folder 17, 18 is shown on which the paper web which was imprinted by the respective The number of pages indicated in the table relates to the case wherein paper webs of a full width of six pages are imprinted. Webs of a width of four pages or of two pages can of course also be used. In that case the indicated number of pages is correspondingly reduced.

While a preferred embodiment of printing machines comprising several printing groups, in accordance with the present invention has been set forth fully and completely hereinabove, it will be apparent to one of skill in the art that various changes in, for example, the types of roll stands for the webs, the structure of the cooling rollers and the like could be made without departing from the true spirit and scope of the present invention which is accordingly to be limited only by the following claims.

What is claimed is:

1. A printing press comprising:

a first structural component including a first printing group, a first dryer and a first turning bar, said first printing group having first printing cylinders with first axes of rotation and defining a first printing gap;

a second structural component including a second printing group, a second dryer and a second turning bar, said second printing group having second printing cylinders with second axes of rotation and defining a second printing gap;

a third structural component including a third printing group, a third dryer and a third turning bar, said third printing group having third printing cylinders with third axes of rotation and defining a third printing gap;

a first folder arranged in a first space between said structural components, said first folder including a first transverse cutting cylinder having a first cutting cylinder axis of rotation parallel to at least one of said first, second and third printing cylinder axes of rotation; and a second folder arranged in a second space between said structural components, said second folder including a second transverse cutting cylinder having a second cutting cylinder axis of rotation, said first and second folders being aligned in a direction of said first and second transverse cutting cylinder axes of rotation, said first, second and third printing groups being aligned in a direction of said first, second and third printing cylinder axes of rotation.

2. The printing press of claim 1 wherein each said first, second and third dryer has a longitudinal direction arranged transversely to said printing cylinder axis of rotation of an associated one of said first, second and third printing groups.

3. The printing press of claim 1 wherein each said printing group includes a web guidance path extending from a lower printing group section to an upper printing group section, each said dryer being arranged at a height of said upper printing group section of said associated printing group.

4. The printing press of claim 1 wherein each said dryer bridges an area between an associated one of said printing groups and one of said first and second folders.

5. The printing press of claim 4 further including at least one roll changer associated with each said printing group and included in said bridged area.

6. The printing press of claim 1 further including a roll changer positioned beneath at least one of said first, second and third dryers.

7. The printing press of claim 1 including a fourth structural component.

8. The printing press of claim 7 wherein said first folder is arranged centered with respect to said first, second third and fourth structural components.

9. The printing press of claim 1 wherein said second folder is arranged between said first and second structural components.

10. The printing press of claim 1 wherein said first and second spaces are adjacent.

11. The printing press of claim 1 wherein said first and second spaces are non-adjacent.

12. The printing press of claim 1 wherein in a first mode of operation both of said first and second folders are operational and in a second mode of operation a selected one of said first and second folders is operational.

13. The printing press of claim 1 wherein said printing press is a telephone directory printing press.

14. The printing press of claim 13 wherein each said printing cylinder has a width of six pages.

15. The printing press of claim 14 wherein each said printing cylinder has a circumference of four pages.

16. The printing press of claim 13 wherein each said printing cylinder has a circumference of four pages.

17. The printing press of claim 1 further including a cooling roller group associated with each of said first, second and third dryers.

* * * * *